US005417154A

United States Patent [19]

Plaats

[11] Patent Number: 5,417,154

[45] Date of Patent: May 23, 1995

[54] SYSTEMS FOR CONTINUOUSLY AND AUTOMATICALLY CRUSHING ALUMINUM CANS

[76] Inventor: Frank V. Plaats, 18601 E. River Rd., Ripon, Calif. 95366

[21] Appl. No.: 202,644

[22] Filed: Feb. 28, 1994

[51] Int. Cl.[6] ..... B30B 9/32; B30B 15/30

[52] U.S. Cl. ..... 100/100; 100/216; 100/257; 100/283; 100/902

[58] Field of Search ..... 100/100, 216, 257, 283, 100/902

[56] References Cited

U.S. PATENT DOCUMENTS

| | | | |
|---|---|---|---|
| 3,659,520 | 5/1972 | Garrett et al. | 100/216 |
| 3,817,169 | 6/1974 | Bischoff | 100/216 X |
| 5,327,822 | 7/1994 | Koenig | 100/216 |

*Primary Examiner*—Stephen F. Gerrity

[57] ABSTRACT

A system for crushing aluminum cans comprising a work table with four legs and wheels on a pair of the legs, a power cylinder mounted on the table for crushing aluminum cans, a power source mounted on the table for reciprocating the power cylinder, and aluminum can handling mechanisms for receiving and retaining a plurality of aluminum cans to be crushed and allowing passage of crushed aluminum cans therethrough for collection therebeneath.

1 Claim, 5 Drawing Sheets

SYSTEMS FOR CONTINUOUSLY AND AUTOMATICALLY CRUSHING ALUMINUM CANS

BACKGROUND OF THE INVENTION

1. Field of the Invention

The present invention relates to systems for continuously and automatically crushing aluminum cans and more particularly pertains to crushing cans in a continuous and automatic cycle of operation.

2. Description of the Prior Art

The use of can crushers is known in the prior art. More specifically, can crushers heretofore devised and utilized for the purpose of crushing aluminum cans are known to consist basically of familiar, expected, and obvious structural configurations, notwithstanding the myriad of designs encompassed by the crowded prior art which has been developed for the fulfillment of countless objectives and requirements.

The prior art discloses a large number of can crushers. By way of example, U.S. Pat. No. 4,265,170 to Schulze, Jr. discloses a solenoid actuated container crusher.

U.S. Pat. No. 4,570,536 to Dodd discloses an electrically actuated can crusher.

U.S. Pat. No. 4,606,265 to Meier discloses an apparatus for crushing cans.

U.S. Pat. No. 5,067,398 to Thoma discloses a can crusher.

Lastly, U.S. Pat. No. 5,103,721 to Chou discloses an aluminum can recycling appliance and method.

In this respect, systems for continuously and automatically crushing aluminum cans according to the present invention substantially depart from the conventional concepts and designs of the prior art, and in doing so provide an apparatus primarily developed for the purpose of crushing cans in a continuous and automatic cycle of operation.

Therefore, it can be appreciated that there exists a continuing need for new and improved systems for continuously and automatically crushing aluminum cans which can be used for crushing cans in a continuous and automatic cycle of operation. In this regard, the present invention substantially fulfills this need.

SUMMARY OF THE INVENTION

In view of the foregoing disadvantages inherent in the known types of can crushers now present in the prior art, the present invention provides improved systems for continuously and automatically crushing aluminum cans. As such, the general purpose of the present invention, which will be described subsequently in greater detail, is to provide new and improved systems for continuously and automatically crushing aluminum cans and methods which have all the advantages of the prior art and none of the disadvantages.

To attain this, the present invention essentially comprises a new and improved system for continuously and automatically crushing aluminum cans constructed in accordance with the principles of the present invention comprising, in combination, a work table having a planar upper surface, four legs and wheels on a pair of the legs, the work table having an operational side and a power side; a power cylinder mounted on the table adjacent the operational side thereof, the power cylinder including a cylindrical member with a hollow cylindrical interior and a cylindrical ram reciprocable therein; a power source mounted on the table adjacent to the power side thereof, the power source including a motor with a rotatable crank and a power transfer rod, the power transfer rod coupled at one end to the crank and at the other end to an input end of the ram whereby rotation of the crank will translate to reciprocation of the ram within the cylinder; aluminum can handling mechanisms at the operational side of the ram, such handling mechanisms including an angled support for receiving and retaining a plurality of aluminum cans to be crushed between their axes parallel to each other, the support being positioned at an angle from the horizontal with an upper end remote from the ram and a lower end in the path of travel of the ram with a can supporting surface therebeneath whereby when the ram is retracted into the cylinder a space is formed on the supporting surface for receiving the next can from the feed support and when the ram is advanced to a crush position, it will crush the can on the support, the support including an aperture of a size to allow passage of the crushed can therethrough for collection therebeneath; resilient means coupled to the ram adapted to assist in positioning a can into the crushing position over the support and aperture; and adjustment mechanisms on the power transfer rod for varying the stroke of the ram.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved systems for continuously and automatically crushing aluminum cans which have all the advantages of the prior art can crushers and none of the disadvantages.

It is another object of the present invention to provide new and improved systems for continuously and automatically crushing aluminum cans which may be easily and efficiently manufactured and marketed.

It is a further object of the present invention to provide new and improved systems for continuously and automatically crushing aluminum cans which are of a durable and reliable construction.

An even further object of the present invention is to provide new and improved systems for continuously and automatically crushing aluminum cans which are susceptible of a low cost of manufacture with regard to both materials and labor, and which accordingly are then susceptible of low prices of sale to the consuming public, thereby making such systems for continuously and automatically crushing aluminum cans economically available to the buying public.

Still yet another object of the present invention is to provide new and improved systems for continuously and automatically crushing aluminum cans which provide in the apparatuses and methods of the prior art some of the advantages thereof, while simultaneously overcoming some of the disadvantages normally associated therewith.

Even still another object of the present invention is to crush cans in a continuous and automatic cycle of operation.

Lastly, it is an object of the present invention to provide a system for crushing aluminum cans constructed in accordance with the principles of the present invention comprising a work table having a planar upper surface, four legs and wheels on a pair of the legs, the work table having an operational side and a power side; a power cylinder mounted on the table adjacent the operational side thereof, the power cylinder including a cylindrical member with a hollow cylindrical interior and a cylindrical ram reciprocable therein; a power source mounted on the table adjacent to the power side thereof, the power source including a motor with a rotatable crank and a power transfer rod, the power transfer rod coupled at one end to the crank and at the other end to an input end of the ram whereby rotation of the crank will translate to reciprocation of the ram within the cylinder; and aluminum can handling mechanisms at the operational side of the ram, such handling mechanisms including an angled support for receiving and retaining a plurality of aluminum cans to be crushed between their axes parallel to each other, the support being positioned at an angle from the horizontal with an upper end remote from the ram and a lower end in the path of travel of the ram with a can supporting surface therebeneath whereby when the ram is retracted into the cylinder a space is formed on the supporting surface for receiving the next can from the feed support and when the ram is advanced to a crush position, it will crush the can on the support, the support including an aperture of a size to allow passage of the crushed can therethrough for collection therebeneath.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
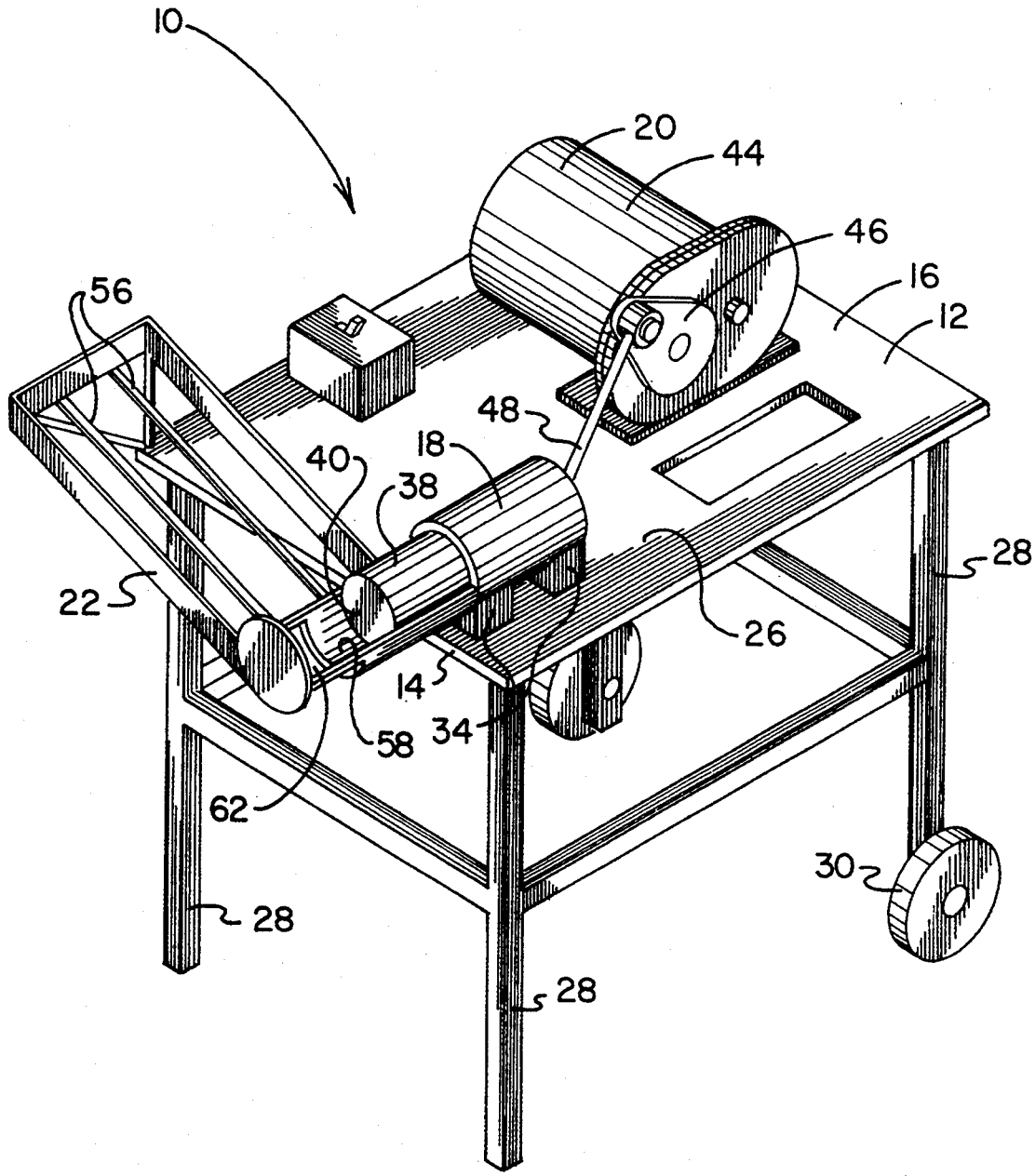
FIG. 1 is a perspective illustration of the preferred embodiment of the system for continuously and automatically crushing aluminum cans constructed in accordance with the principles of the present invention.
Figure 2:
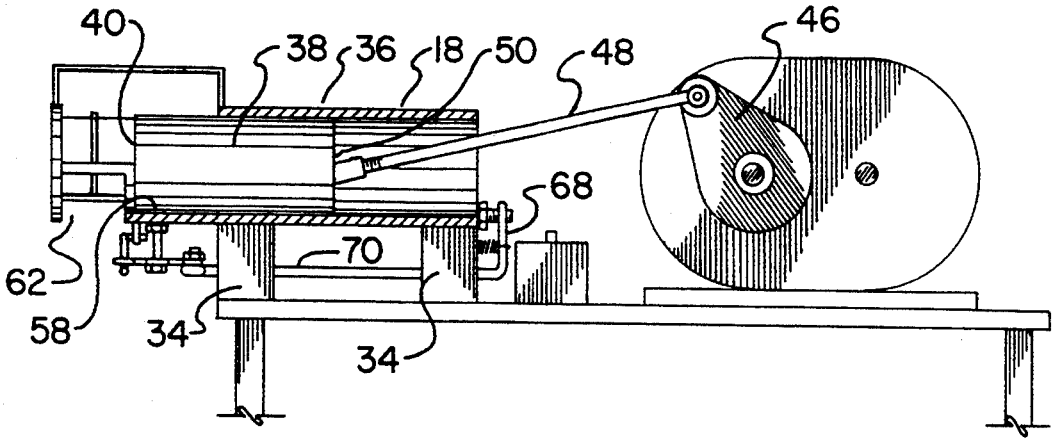
FIG. 2 is a side elevational view of the power side of the system shown in FIG. 1 with parts shown in a sectional view.
Figure 3:
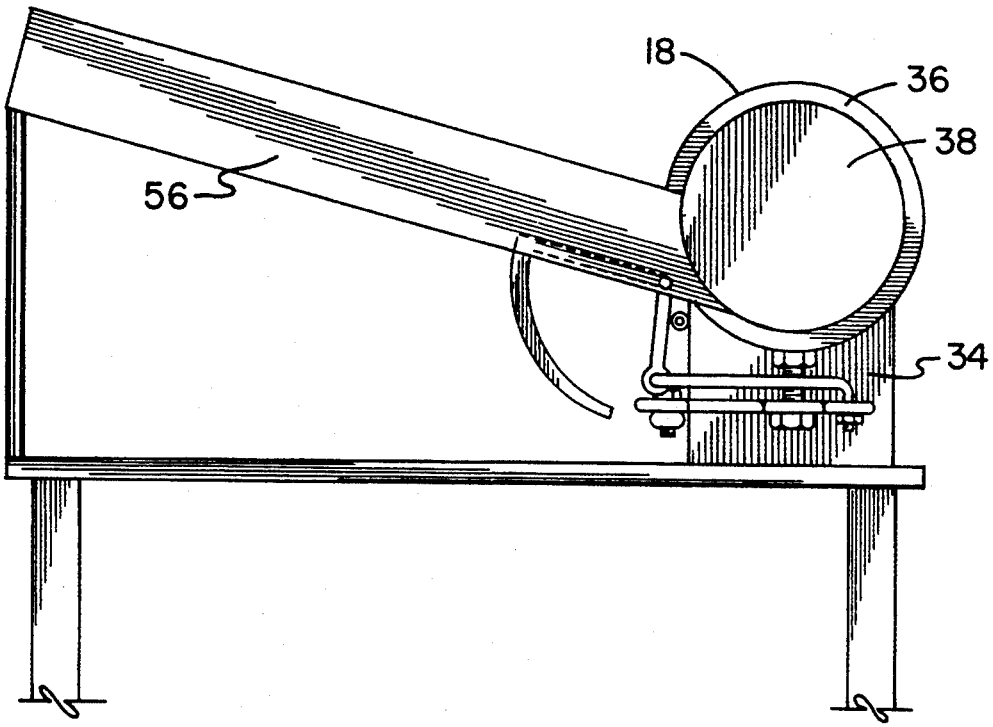
FIG. 3 is an enlarged end side elevational view of the operational side of the system shown in FIG. 1.
Figure 4:
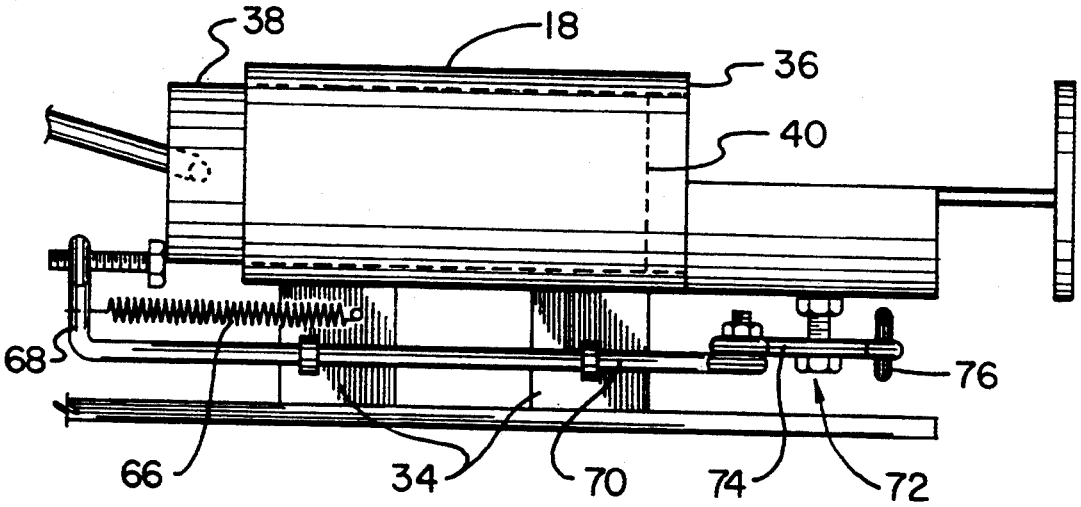
FIG. 4 is an enlarged side elevational view of the can crushing components similar to FIG. 2 but taken from the opposite side thereof.
Figure 5:
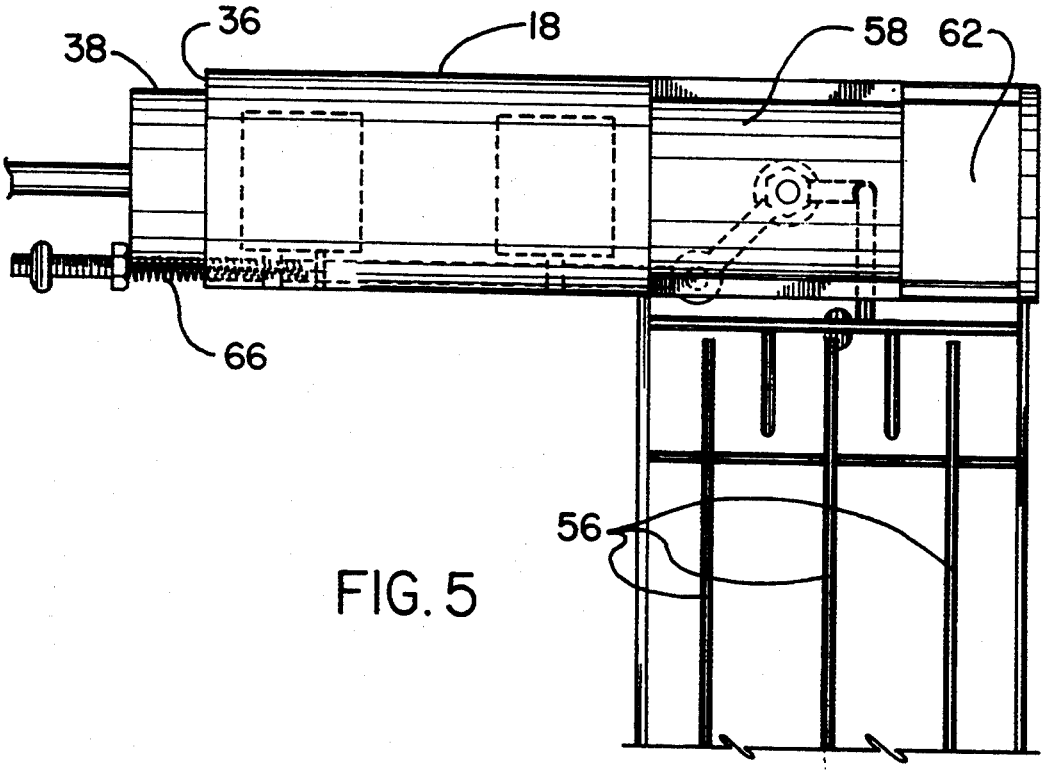
FIG. 5 is a top plan view of the components shown in FIG. 4.
Figure 6:
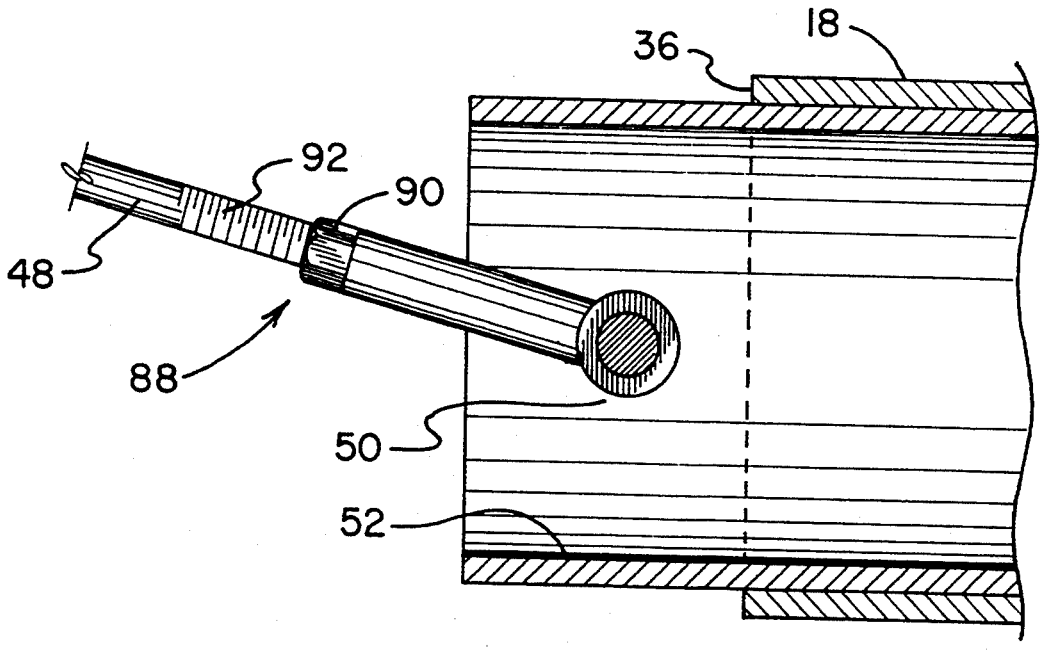
FIG. 6 is an enlarged sectional view of the coupling between the power rod and cylinder.
Figure 7:
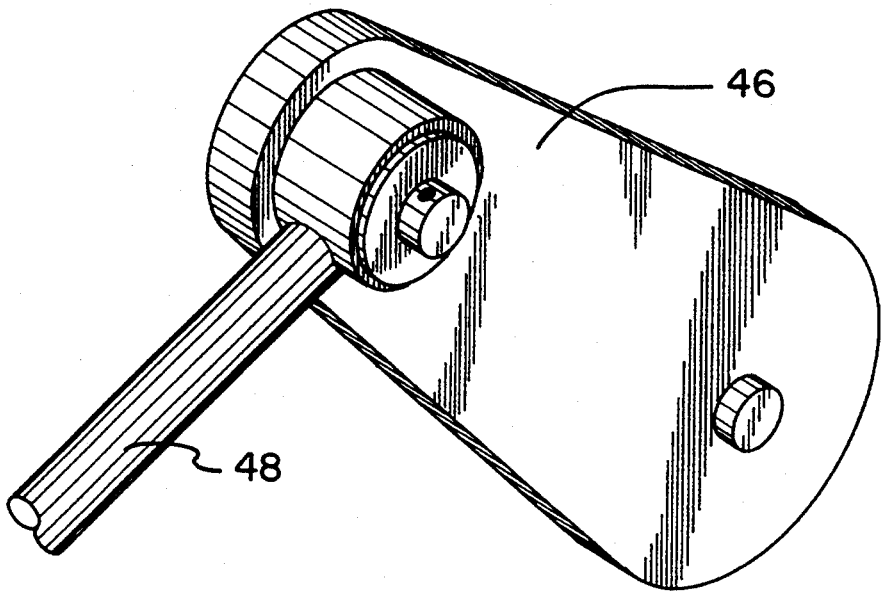
FIG. 7 is an enlarged perspective view of the coupling between the power rod and the crank.
Figure 8:
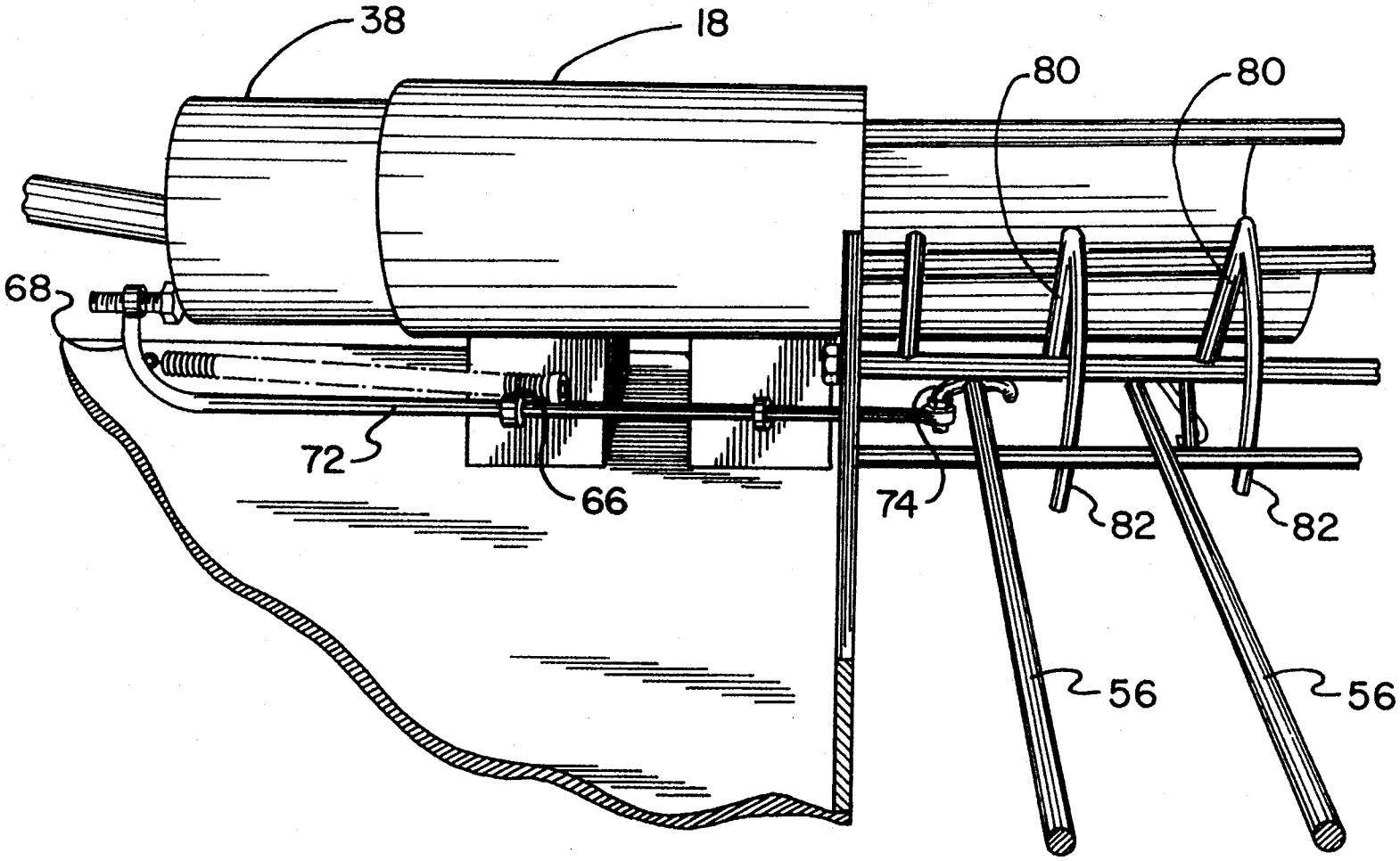
FIG. 8 is a perspective illustration of the mechanisms for moving cans one at a time into position for being crushed.

With reference now to the drawings, and in particular to FIGS. 1 through 8 thereof, the preferred embodiment of the new and improved systems for continuously and automatically crushing aluminum cans embodying the principles and concepts of the present invention and generally designated by the reference numeral 10 will be described.

Specifically, the system 10 of the present invention, the new and improved systems for continuously and automatically crushing aluminum cans, includes as its basic components, a table 12 having an operational side 14 and a power side 16. A power cylinder 18 is located on the crushing or operational side 14 of the system. A motor or other power source 20 is located on the power side 16 of the system. Can handling mechanisms 22 are located at the operational side 14 of the system whereat the cans, not shown, are located, fed and crushed.

More specifically, the work table 12 is provided with a planar upper surface 26. It is also provided with four legs 28 extending downwardly therefrom for the sake of repositioning the work table and system, wheels 30 are located on an adjacent pair of legs to allow convenient movement and repositioning.

The main operational component of the system is the power cylinder 18. The power cylinder is located at the crushing or operational side 14 of the system 10 and table 12. The power cylinder is securely mounted to the upper surface 26 of the table 12 through fixed support blocks 34. The power cylinder includes a cylindrical member 36. The cylinder has a hollow cylindrical interior. Located within the cylindrical interior is a ram 38. The ram is a solid cylindrical member which is sized and shaped to reciprocate within the cylinder 36 during its extended position for crushing. The leading edge 40 and a portion of the ram extend outwardly from the cylinder 36 during crushing.

Next provided in the system is a power source 20. The power source is located at the power side 16 of the table 12 and system 10. The power source includes a motor 44 with a rotatable crank 46 secured to the motor for rotation therewith. A power transfer rod 48 is coupled at one end to the crank 46. At its other end, the power transfer rod is coupled to the input end 50 of the ram 38. In this manner, activation of the motor 44 and rotation of the crank 46 will translate such motion through the power transfer rod 48 to the reciprocation of the ram 38 within the cylinder 36. The connection between the ram and power transfer cylinder is through a recess 52 located at the adjacent end of the ram.

The next major component of the system 10 is the aluminum can handling mechanisms 22. Such mechanisms are located at the crushing or operational side 14 of the table 12 and system 10. Such mechanisms 22 include an angled support 56 for receiving and retaining a plurality of aluminum cans to be crushed. The cans are positioned on the support with their axes parallel to each other. The support is positioned at an angle from the horizontal with its upper end remote from the ram 36. The lower end of the support is adjacent to the path of travel of the ram 38. The angle support terminates at its lower end with a can supporting surface 58 therebeneath. In this manner, when the ram is retracted into the cylinder 36, a space is formed on the supporting surface 58 for receiving the next can from the angled support 56. When the ram 38 is advanced to the crush position, it will crush the can located on the support surface 58.

The support surface 58 includes an aperture 62. The aperture is of such size as to allow retention of the can in the path of travel of the ram when first positioned on the support surface. The aperture 62 is of such size, however, as to allow the passage of the crushed can through the aperture of the support surface for subsequent collection in a bucket or other container located immediately beneath the aperture.

Other components of the system for increasing its utility and efficiency include resilient means in the form of a spring 66. Note in particular FIGS. 2, 4 and 5. Such spring has a first end secured to an adjacent support block 34 with its other end secured to an upturned fixed extension 68 of a reciprocable rod 70. An adjustment bolt is in riding contact with the reciprocating ram. Reciprocation of the ram thus reciprocates the rod 70. The opposite end of the rod 70 is located adjacent to the angled support with an associated lever mechanism 72.

The lever mechanism 72 includes the rod 70 as an input link, a pivotable intermediate link 74 and an output link 76. In use the end of the support 56 adjacent surface 58 is at a lower elevation requiring a lifting of the can prior to positioning for being crushed. Liner rods 80 oscillate to effect such lifting and positioning of the next adjacent can. The oscillation is caused by the withdrawn ram 38 contacting and moving extension 68. Arcuate fingers 82 at the outboard ends of the rods 80 preclude the next following can from being advanced prematurely. More specifically, oscillation of extension 68 and rod 70 will pivot link 74 to oscillate output link 76 and rods 80.

Such mechanism 72 is thus adapted to extend the fingers 82 upwardly into the path of travel of the following cans to preclude the next adjacent can from entering the support surface 58 until the ram is withdrawn. This allows the dropping of the crushed can and the freeing-up of a space on the support surface in a continuing and automatic cycle of operation.

Also preferably used in association with the system is a first adjusting mechanism 88. Such first adjusting mechanism is located on the power transfer rod. It includes threads 90 on the rod 48 and an associated threaded nut 92 to allow a change in the effective length of the power transfer rod. This, in effect, varies the stroke of the rod as a function of the length of the can to be crushed.

Recycling facilities must store thousands of aluminum cans before they sell them. These cans take up valuable storage space, and therefore must be crushed so they can fit more cans in a smaller space. Household can crushers which crush one can at a time cannot accommodate the volume of recycling centers.

The present invention allows a high-volume recycling center to automatically crush large numbers of cans. On one end of the present invention is a motor attached to an arm with a large cylinder at the end. At the other end is a can feeder which is pitched at an angle so the cans will flow one at a time into the path of the large cylinder.

An operator turns the present invention on and places cans into the can feeder. The mechanical arm moves back and forth, crushing each can with the cylinder, then gravity forces the next can into the crusher. The feeder holds six cans at one time and a bucket underneath the feeder in order to catch the cans that have been crushed. The operator must empty and replace the bucket when it is full.

The present invention is made of steel and sits on top of a table approximately the size of a television table or microwave cart. There are two wheels on one end, so the unit can be pushed like a wheelbarrow to a spot that is convenient to the operator. The present invention can be used indoors or out, as long as there is power available.

The present invention allows a recycling center or any other facility involved in the storage of high volume aluminum cans to automatically crush cans with very little effort. The present invention frees up storage space, is easy to use, requires little training, and does not take up a great deal of space.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A system for continuously and automatically crushing aluminum cans comprising, in combination:

a work table having a planar upper surface, four downwardly extended legs and wheels on a pair of the legs, the work table having an operational side and a power side;

a power cylinder having a pair of fixed support blocks extended downward therefrom and with the support blocks securely mounted on the table adjacent the operational side thereof, the power cylinder including a cylindrical member with a hollow cylindrical interior and a solid cylindrical ram reciprocable therein, the ram further having a recessed input end and an opposed flat leading edge remote from the input end and with a portion of the cylindrical ram adjacent to the leading edge extendable from the cylindrical member when fully reciprocated;

a power source mounted on the table adjacent to the power side thereof, the power source including a motor with a rotatable cam-shaped crank secured to the motor for rotation therewith and a power transfer rod, the power transfer rod coupled at one end to the crank and at the other end to the input end of the ram whereby rotation of the crank will translate to reciprocation of the ram within the cylinder;

aluminum can handling mechanisms at the operational side of the ram, such handling mechanisms including an angled support for receiving and retaining a plurality of aluminum cans to be crushed with the cans oriented thereupon in sequence such that their axes are aligned in parallel, the support being positioned at an angle from the horizontal with an upper end remote from the ram and a lower end in the path of travel of the ram with a can supporting surface therebetween whereby when the ram is retracted into the cylinder a space is formed on the supporting surface for receiving the next can from the angled support and when the ram is advanced to a crush position, it will crush the can on the support, the support including an aperture of a size to allow passage of the crushed can therethrough for collection therebetween;

a lever mechanism further comprising a reciprocal rod serving as an input link slidably secured to the support blocks of the power cylinder, an output link terminated at liner rods with downwardly extended arcuate fingers and with the fingers interposable within the angled support, a pivotable intermediate link coupled between the input link and the output link, an extension integrally coupled to and projected upwards from the input link and abutted against the input end of the ram, and resilient means in the form of a spring having one end secured to the extension and the other end secured to a support block and with the liner rods being raised by the lever mechanism to preclude another can from being positioned upon the support surface from the angled support when the ram is extended within the cylindrical member and with the liner rods being lowered by the lever mechanism when the ram is withdrawn from the cylindrical member to allow another can to be positioned upon the support surface from the angled support for crushing;

and a threadedly adjustable adjustment mechanism integrally coupled to the power transfer rod at a location adjacent to the ram for allowing the effective length of the power transfer rod to be modified for varying the stroke of the ram.

* * * * *